US006793258B2

(12) United States Patent
Gray

(10) Patent No.: US 6,793,258 B2
(45) Date of Patent: Sep. 21, 2004

(54) DEVICE AND METHOD FOR GRIPPING A HANDRAIL

(75) Inventor: Larry B. Gray, Merrimack, NH (US)

(73) Assignee: DEKA Products Limited Partnership, Manchester, NH (US)

( * ) Notice: Subject to any disclaimer, the term of this patent is extended or adjusted under 35 U.S.C. 154(b) by 0 days.

(21) Appl. No.: 10/101,537

(22) Filed: Mar. 19, 2002

(65) Prior Publication Data

US 2002/0130525 A1 Sep. 19, 2002

Related U.S. Application Data

(60) Provisional application No. 60/277,019, filed on Mar. 19, 2001.

(51) Int. Cl.[7] ..... B66C 1/42

(52) U.S. Cl. ..... 294/103.1; 294/15; 74/551.9; 182/133; 187/200

(58) Field of Search ..... 294/15, 103.1; 74/551.9; 182/133, 136; 187/200; 200/522

(56) References Cited

U.S. PATENT DOCUMENTS 4,062,209 A 12/1977 Downing et al.
4,130,177 A * 12/1978 Pandolph ..... 182/8
4,899,989 A * 2/1990 Kitson et al. ..... 256/1
5,659,904 A * 8/1997 Doczy et al. ..... 4/577.1
5,701,965 A 12/1997 Kamen et al.
5,979,840 A * 11/1999 Hollister et al. ..... 248/76

OTHER PUBLICATIONS

Greenwood, European Patent Application EP0320224A2.*
Lewis, UK Patent Application GB2335933A.*
Baria, UK Patent Application GB2106790A.*
Wilson, European Patent Application EP0452017A1.*
Parkinson, UK Patent Application GB2225600A, Jun. 6, 1990.*

* cited by examiner

*Primary Examiner*—Eileen D. Lillis
*Assistant Examiner*—Michael Lowe
(74) *Attorney, Agent, or Firm*—Bromberg & Sunstein LLP

(57) ABSTRACT

A device and method for gripping a handrail or other object having a top and a bottom surface. The device includes a handle for gripping by a user. A fixed member is coupled to the handle for engaging one of the top and bottom surfaces of the handrail, and a movable member is movably coupled to the handle for engaging the other of the top and bottom surfaces of the handrail. An actuator coupled to the handle controls the movement of the movable member, the actuator allowing for repositioning and locking of the device with respect to the handrail. When the device is locked with respect to the handrail the fixed member and movable member engage the top and bottom surfaces of the handrail such that a force tangential to the handrail can be applied to the handle without the device sliding on the handrail.

30 Claims, 9 Drawing Sheets

DEVICE AND METHOD FOR GRIPPING A HANDRAIL

CROSS REFERENCE TO RELATED APPLICATIONS

This application claims priority from U.S. provisional application serial No. 60/277,019, filed Mar. 19, 2001, entitled "Device and Method for Gripping a Handrail", the disclosure of which is incorporated herein by reference.

TECHNICAL FIELD AND BACKGROUND ART

The present invention pertains to a device and method for gripping a handrail or other object.

A personal vehicle, such as may be used by a disabled person, may be self-propelled and user-guideable. Examples of such a vehicle include balancing vehicles described in U.S. Pat. Nos. 5,701,965 and 6,311,794, both of which are incorporated herein by reference.

FIG. 1 shows a balancing vehicle, designated generally by numeral 120. Balancing vehicle 120 may include one or more clusters 121 of wheels 122, 123, as shown in FIG. 1. The cluster 121, and the wheels 122, 123 in each cluster 121, are controlled by a controller 128 and may be driven independently of each other. Controller 128 may operate in several modes, including a balancing mode in which the controller 128 is allowed to balance and drive the vehicle 120 by providing commands to drive the wheels 122, 123.

A rider 124 in such a balancing vehicle 120 can climb or descend stairs (not shown). This may be accomplished by having the rider 124 lean the vehicle 120 in the forward direction to travel down the stairs or in the rearward direction to travel up the stairs. To lean the vehicle 120, the rider 124 pushes off of or pulls on the stair handrail (not shown), causing the cluster 121 to rotate in such a manner as to place the second wheel 123 (i.e. the wheel not currently in ground contact) of each cluster 121 onto the appropriate stair. Therefore, the rider 124 must maintain a good grip on the handrail to maintain control of the balancing vehicle 120. However, the user may have poor arm and hand strength or limited dexterity, making this task difficult.

SUMMARY OF THE INVENTION

In one embodiment of the invention, a device for gripping a wide variety of objects that have a top and a bottom surface is presented. Objects may include, for example and without limitation, a counter, a table, or a desk. Additionally, the device may be advantageously used to grip a handrail. It is to be understood that the description in terms of gripping a handrail is without limitation and by way of example only.

The device includes a handle for gripping by a user. A fixed member is coupled to the handle for engaging one of the top and bottom surfaces of the handrail, and a movable member is movably coupled to the handle for engaging the other of the top and bottom surfaces of the handrail. An actuator coupled to the handle controls the movement of the movable member, the actuator allowing for repositioning and locking of the device with respect to the handrail. When the device is locked with respect to the handrail the fixed member and movable member engage the top and bottom surfaces of the handrail such that a force tangential to the handrail can be applied to the handle without the device sliding on the handrail.

In a related embodiment of the invention, the fixed member may include an outer jaw for engaging one of the top and bottom surfaces of the handrail.

In another related embodiment of the invention, the actuator includes a locking cam for controlling the movement of the movable member. The locking cam and/or the movable member may include an engageable coupling for engaging one another. The engageable coupling may include threads. The actuator may include a bias mechanism for supplying a return force to the locking cam and for providing a force on the movable member that is perpendicular to the top and bottom surfaces of the handrail. The bias mechanism may be a spring. The actuator may include a guide, the guide providing a surface for the spring and locking cam to contact.

In yet another related embodiment of the invention, the movable member includes a pressure foot for engaging the other of the top and bottom surfaces of the handrail. The pressure foot may include a surface that is concave for engaging the other of the top and bottom surfaces of the handrail so as to prevent slippage on the handrail. The pressure foot may be extended so that so that the pressure foot can be pushed against the handrail when the pressure foot and fixed member are in close proximity, to create clearance for the device to be slid over the handrail.

In another embodiment of the invention, a device for gripping a handrail having a top surface and a bottom surface is presented. The device includes a handle for gripping by a user; the handle having a fixed outer jaw for engaging one of the top and bottom surfaces of the handrail. The handle has walls defining a cavity having a first entrance facing the outer jaw. A foot assembly has a first end that travels inside the cavity and a second end that extends out the first entrance. The second end of the foot assembly is coupled to a pressure foot. The pressure foot has an outer surface facing the outer jaw for engaging the other of the top and bottom surfaces of the handrail. A locking cam is located inside the cavity, for controlling movement of the movable foot assembly in such a manner to allow for repositioning and locking of the device with respect to the handrail, such that a force tangential to the handrail can be applied to the handle without the device sliding on the handrail. The locking cam may include a cam actuator that extends out a second entrance of the cavity, for controlling the locking cam.

In a related embodiment of the invention, the foot assembly may include a rod having threads for engaging the locking cam. The locking cam may also have threads for engaging the threaded rod.

In another related embodiments of the invention, the locking cam may include a bias mechanism, which supplies a return force to the locking cam and may also provide a force on the movable member that is perpendicular to the top and bottom surfaces of the handrail. The bias mechanism may be a spring.

In related embodiments of the invention, the pressure foot includes a surface that is concave for engaging the other of the top and bottom surfaces of the handrail so as to prevent slippage on the handrail. The pressure foot may also be extended beyond the outer jaw so that the pressure foot can be pushed/pulled against the handrail when the pressure foot and the outer jaw are in close proximity, to create clearance for the device to be slid over the handrail.

In another embodiment of the invention, a method for gripping a handrail having a top and bottom surface is presented. The method comprises applying a fixed member to one of the top and bottom surfaces of a handrail, the fixed member coupled to a handle. A movable member is applied to the other of the top and bottom surfaces of the handrail, the movable member movably coupled to the handle. The fixed member and movable member are locked with respect to the handrail, whereupon the handle is then gripped.

In another related embodiment of the invention, locking the fixed member and the movable member onto the handrail may include utilizing an actuator coupled to the handle to prevent movement of the movable member.

In yet another related embodiment of the invention, the method may further comprise releasing the fixed member and movable member from the handrail and repositioning the fixed member and movable member on the handrail. Releasing the fixed member and the movable from the handrail may include utilizing an actuator to allow movement of the movable member.

In another embodiment of the invention, a method for gripping a handrail having a top and bottom surface is presented. A fixed member is applied to one of the top and bottom surfaces of a handrail, the fixed member coupled to a handle. An actuator is activated to allow movement of a movable member movably coupled to the handle, the actuator coupled to the handle. A force is applied on the handle, the force being perpendicular to the top and bottom surfaces of the handrail, so as to allow the movable member to clamp down on the other of the top and bottom surfaces of the handrail with a spring force. The actuator is released to prevent movement of the movable member, so as to lock the movable member and fixed member with respect to the handrail. The handle is then gripped.

In related embodiments of the invention, activating the actuator releases a locking cam such that the movable member can move. Releasing the actuator may return a locking cam to a locked position, such that the movable member cannot move.

In another related embodiment of the invention, the method further comprises activating the actuator to allow movement of the movable member. A force is applied on the handle, the force being perpendicular to the top and bottom surfaces of the handrail so as to unclamp the movable member and the fixed member from the handrail. The movable member is then repositioned onto the handrail.

In yet another related embodiment of the invention, wherein prior to applying the fixed member, the method further comprises activating the actuator to allow movement of the movable member. The movable member is then pushed against the handrail to further separate the movable member and fixed member, the movable member having an extended pressure foot so that the movable member can be pushed against the handrail when the fixed member and movable member are in close proximity.

BRIEF DESCRIPTION OF THE DRAWINGS

The invention will be more readily understood by reference to the following description, taken with the accompanying drawings, in which.

DETAILED DESCRIPTION OF SPECIFIC EMBODIMENTS

The present invention provides a device for gripping a handrail or other object, such as, for example, a counter, a table or a desk. The device is particularly suited for disabled people climbing stairs in a balancing vehicle, such as that described in U.S. Pat. Nos. 5,701,965 and 6,311,794. The device advantageously allows the user in the balancing vehicle to assume natural hand and arm positions so as to better apply the forces necessary to maintain the necessary balance when climbing the stairs. It is to be understood that the description in terms of the device gripping a handrail is without limitation and by way of example only.

Figure 1:
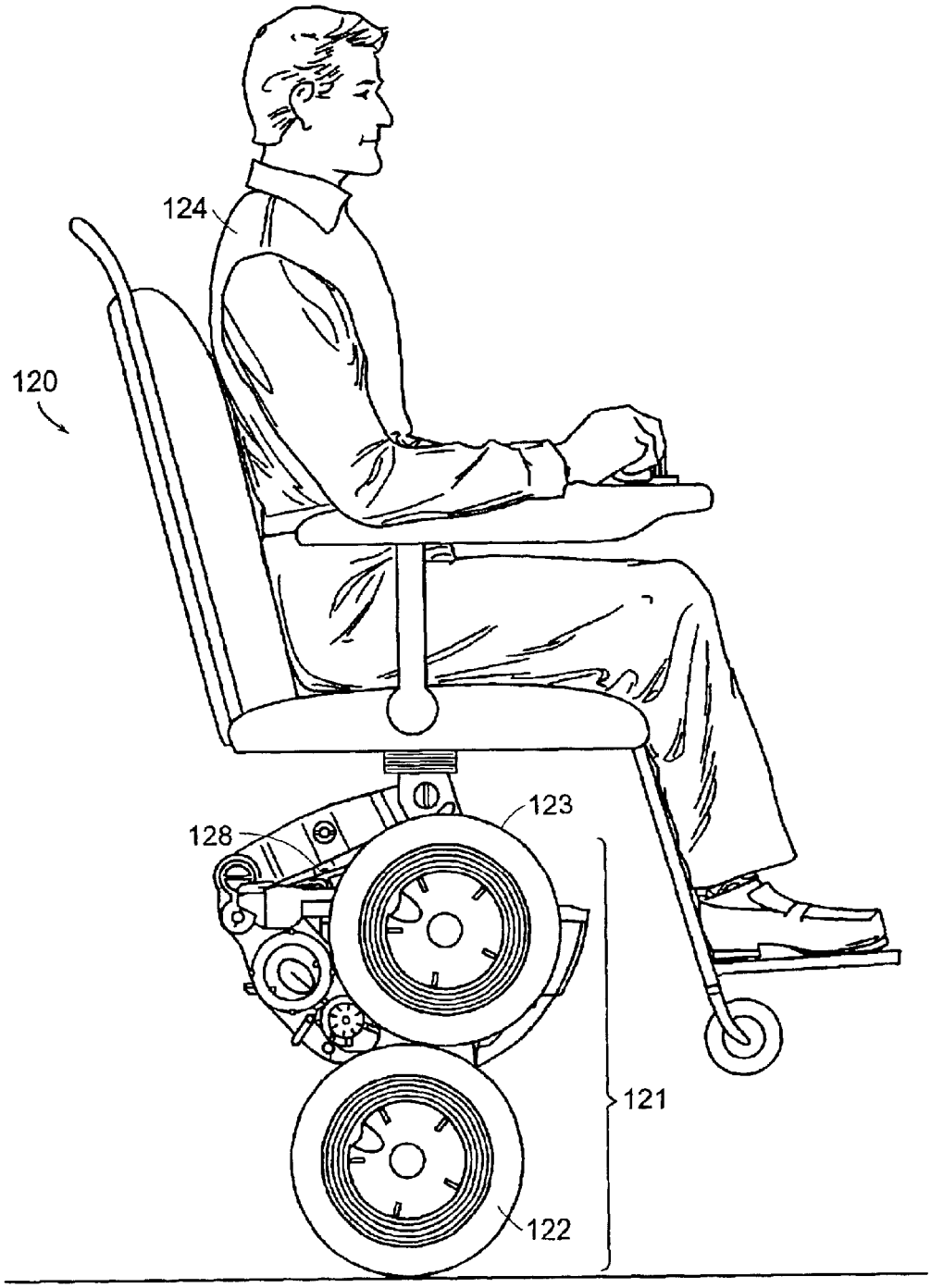
FIG. 1 PRIOR ART
FIG. 1 is a side view of a prior art balancing vehicle.
Figure 2:
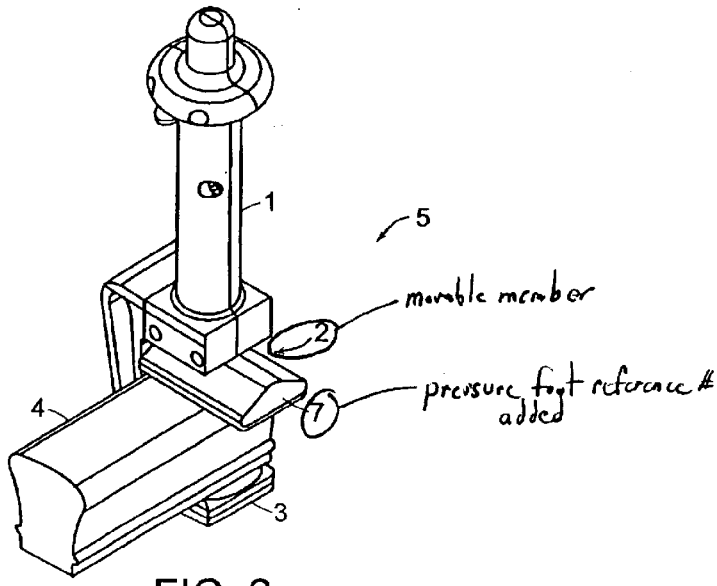
FIG. 2 is an isometric view of a device gripping a typical colonial handrail in accordance with one embodiment of the invention.

FIG. 2 shows the device 5 gripping a typical colonial handrail 4 in accordance with one embodiment of the invention. Device may be made of various materials, including, without limitation, plastic, which may be glass-filled, and various metals such as steel, aluminum, or titanium. Additionally, various parts of the device may be covered by rubber, as described below.

The device 5 has a handle 1, which can be grasped by a user. Handle may be of various shapes, such as, for example, a cylinder or a curved cylinder. The grip of the handle may be coated with a material, such as rubber, and contoured to fit the user's hand.

A fixed member 3, which may include an outer jaw, is coupled to the handle 1, for engaging the bottom surface of the handrail 4. A movable member 2 is movably coupled to the handle 1, for engaging the top surface of the handrail 4. In alternative embodiments of the invention, the fixed member 3 engages the top surface of the handrail 4, while the movable member 2 engages the bottom surface of the handrail 4.

Figure 3:
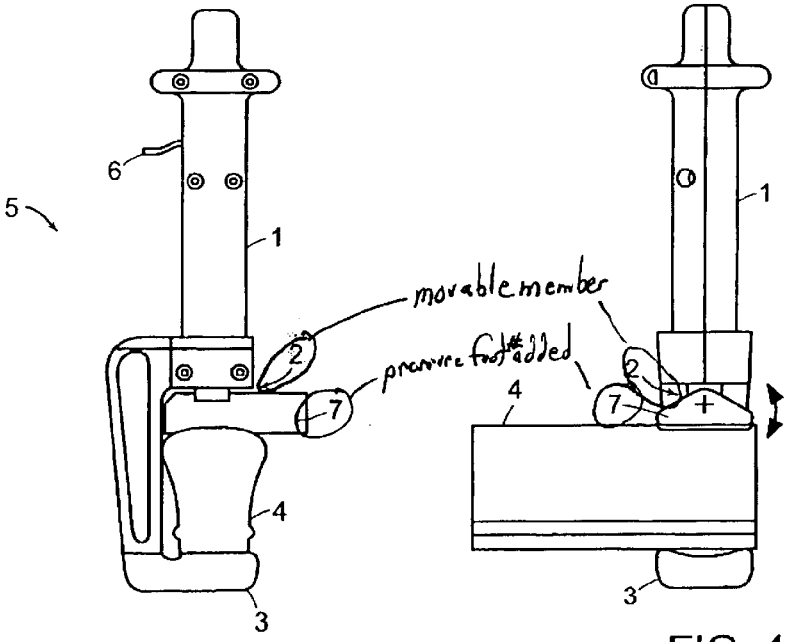
FIG. 3 is a side view of the device in accordance with the embodiment of FIG. 2.

FIG. 3 shows a side view of the device 5. As can be better seen in this view, the handle has an actuator 6 for controlling the movement of the movable member 2. In various embodiments, manipulation of the actuator 6 by an operator either allows or prevents movement of the movable member 2. Actuator 6 includes an operator interface, such as a lever or pushbutton, for controlling the state of the actuator 6.

The actuator 6 may be positioned on or near the top of the handle 1 such that a user grasping the handle 1 can use his thumb to press down on the actuator 6. Alternatively, the actuator 6 may be located on other areas of the device, and be controlled by fingers other than the thumb. In either case, the actuator 6 may be advantageously positioned such that the device 5 can be gripped and the actuator 6 controlled using single-handed operation.

In various embodiments of the invention, the actuator 6 controls a locking cam, such that by pressing down on the actuator 6 the locking mechanism is released and the movable member 2 is free to travel up or down. The locking cam and/or the movable member 2 may include an engageable coupling for engaging one another, such as threads. Instead of a cam, other mechanisms for controlling movement of the movable member 2 may be utilized. For example, a pin or blade could engage a rod with slots to prevent vertical movement of movable member 2.

In various embodiments of the invention, the movable member 2 includes a pressure foot 7 for engaging the handrail 4. To obtain clearance between the fixed member 3 and the movable member 2 so that the device can be slid 5 onto the handrail 4, the pressure foot 7 may extend beyond the fixed member 3, as shown in FIG. 2. Clearance to slide the device over the handrail can then be obtained by pushing the outermost portion of the pressure foot 7 against the top of the handrail 4 when the movable member 2 is free to move. In this manner, the device can be slid onto the handrail using single handed operation, assuming the actuator controlling the movable member 2 is accessible with the same hand that is gripping the handle 1.

The pressure foot 7 may have a concave surface so as to better grasp the handrail and prevent the device from sliding off the handrail 4. Additionally, the surfaces q of the movable member 2, pressure foot 7 and/or fixed member 3 where the handrail is contacted may be coated with a material, such as hard rubber, to increase the coefficient of friction when contacting the handrail. In other embodiments, the coefficient of friction is large enough that a rubber coating is not necessary to prevent slipping.

Figure 4:
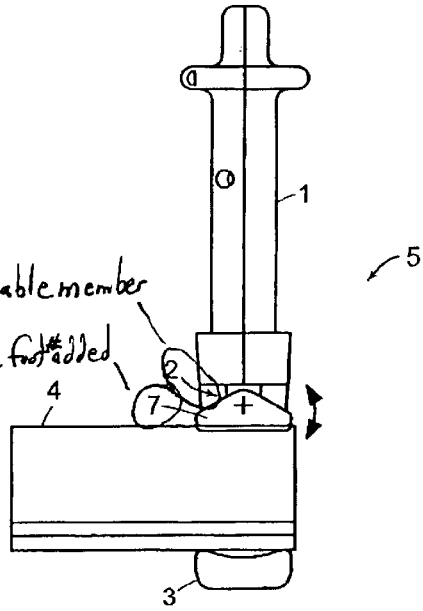
FIG. 4 is a further view of the device in accordance with the embodiment of FIG. 2.

FIG. 4 provides another view of the device 5. In various embodiments of the invention, the pressure foot 7 can rotate, in either direction, along a line perpendicular to the sides of the handrail, so as to keep the force evenly distributed on the handrail 4.

Figure 5:
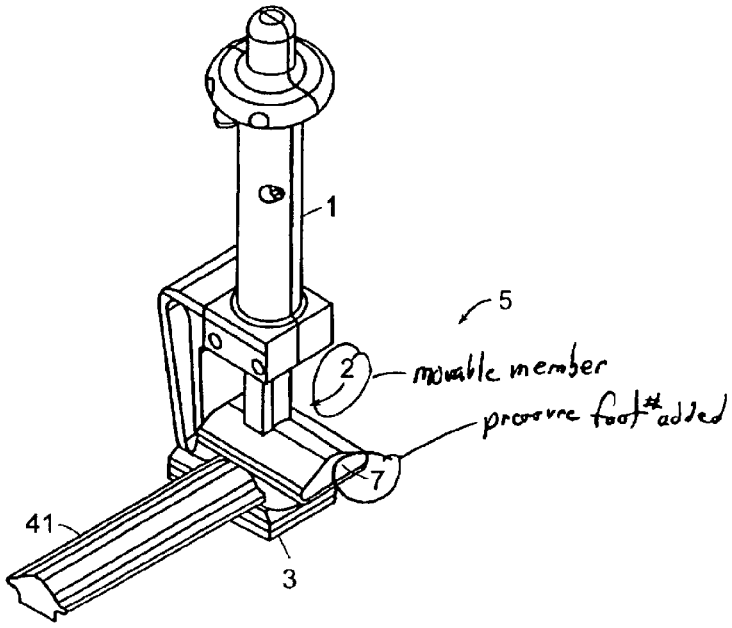
FIG. 5 is an isometric view of a device gripping a typical steel handrail in accordance with one embodiment of the invention.
Figure 6:
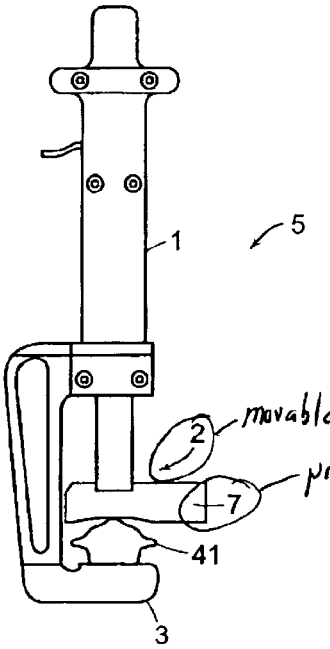
FIG. 6 is a side view of the device in accordance with the embodiment of FIG. 5.
Figure 7:
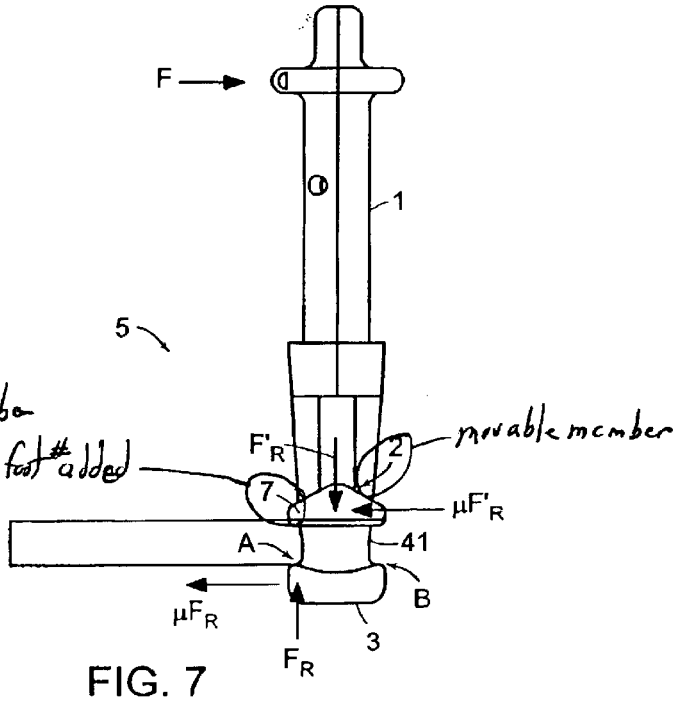
FIG. 7 is a further view of the device in accordance with the embodiment of FIG. 5.

The device can be easily adjusted to suit a large range of handrail sizes and shapes. For example, FIGS. 5–7 show various views of the device 5 adjusted for a steel handrail 41, in accordance with one embodiment of the invention. The movable member 2 includes a pressure foot 7, the pressure foot 7 being further extended from the handle 1 as compared with the device 5 adjusted for a colonial handrail 4, since the height of the steel handrail 41 is smaller.

Pushing or pulling on the handle 1 of the device 5 creates a reaction force at location A or B as shown in FIG. 7, the location of contact points A and B being optimized to prevent slipping while minimizing forces on the handrail 41. A large reaction force $F_R$ perpendicular to the handrail 41 generates a moment that opposes the moment from the force, F, at the handle 1. Thus, a large friction force $\mu F_R$ is created parallel to the handrail 41. A second reaction force $F_R$' from the pressure foot 7 generates a second frictional force $\mu F_R$'. These frictional forces prevent the device 5 from slipping on the handrail 41.

Figure 8:
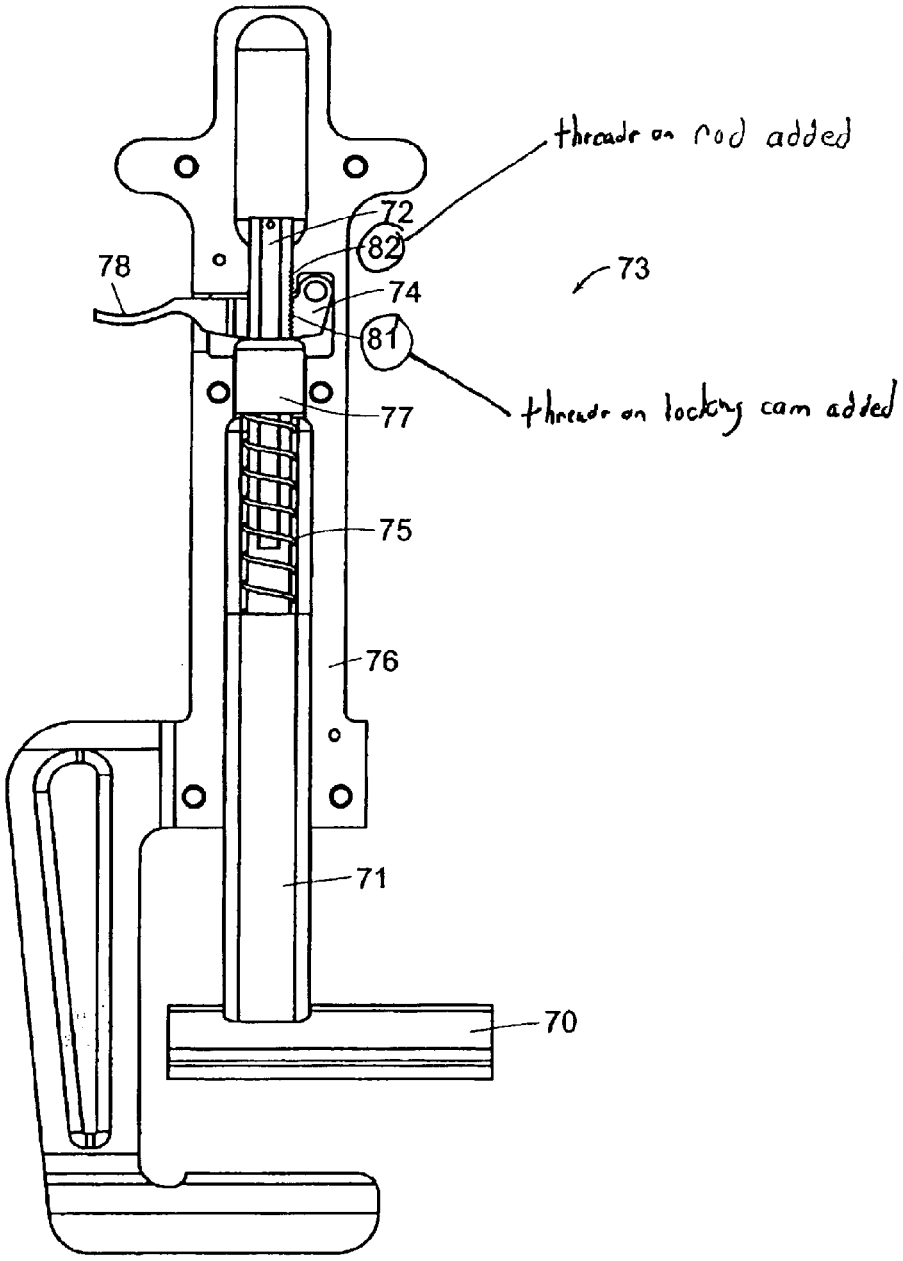
FIG. 8 is a cut-away side view of a device for gripping a handrail in accordance with one embodiment of the invention.
Figure 9:
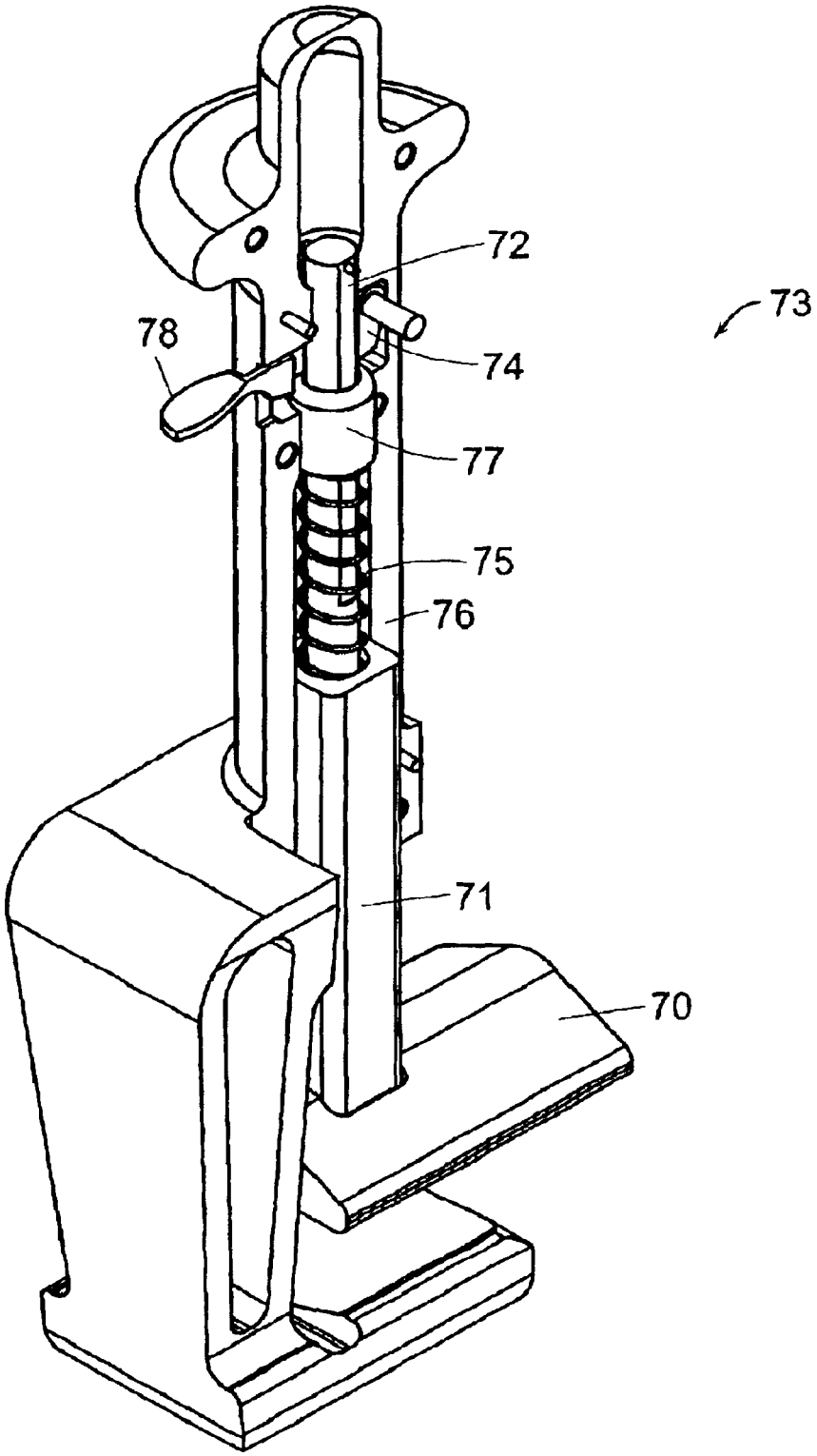
FIG. 9 is a cut-away isometric view of the device in accordance with the embodiment of FIG. 8.
Figure 10:
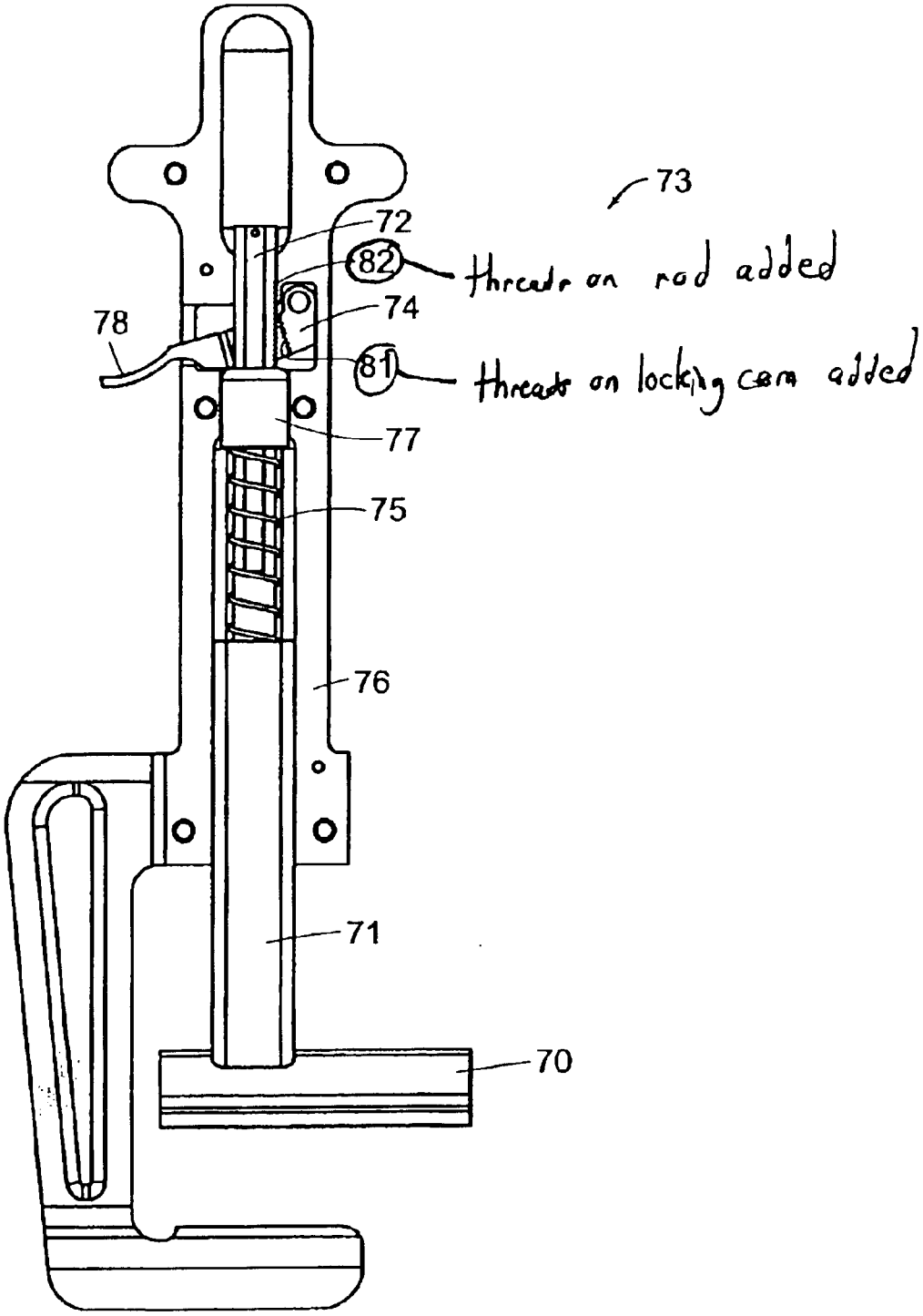
FIG. 10 is a cut-away view of a device for gripping a handrail with the locking mechanism disengaged, in accordance with one embodiment of the invention.

In accordance with one embodiment of the invention, a cut-away side view and an isometric view of a device 73 for gripping a handrail provided in FIGS. 8 and 9, respectively. A movable member includes a pressure foot 70, a foot actuator 71, and a threaded rod 72, which travel as one assembly. Threaded rod 72 may be machined flat on both sides. A locking cam 74 controls movement of the threaded rod 72 and the foot actuator 71 within a cavity of the handle. Depressing an actuator 78 disengages female threads 81 located on one side of the locking cam 74 from male threads 82 on the threaded rod 72, allowing movable member to move up and down within the cavity. A slot in the cam provides clearance when the cam 74 is rotated in the disengaged position, as shown in FIGS. 10 (side view) and 11 (isometric view). A return force for the cam 74 is accomplished with a spring 75. Instead of a spring 75, other bias mechanisms may be utilized, a bias mechanism being any mechanism providing a bias force, as is known in the art. If the bias force is proportional to displacement, the bias mechanism is a "spring." The spring 75 not only returns the cam 74 to the locked position when the actuator 78 is released, but also provides a light downward force on the pressure foot 70. A spring guide 77 on the top of the spring 75 allows smooth operation of the cam 74.

When the user applies a force to the handle 76, a relatively large reaction force drives the threaded rod 72 upward. As a result, the cam 74 is rotated clockwise. The clockwise rotation of the cam 74 causes the threads to engage more tightly. Therefore, the larger the upward force on the threaded rod 72, the harder the cam 74 digs into the threaded rod 72 to prevent rod 72 and pressure foot 70 movement.

Figure 12:
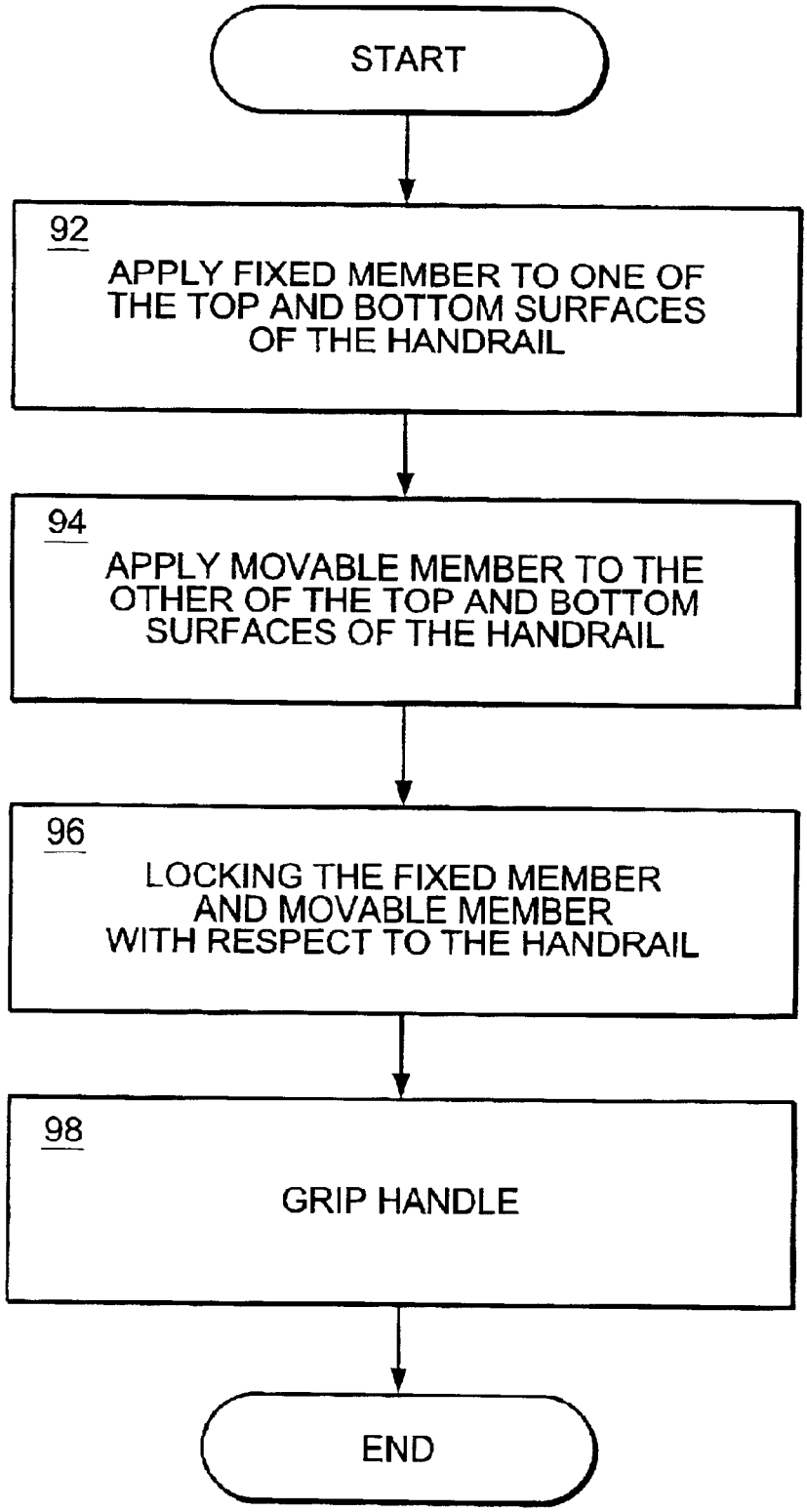
FIG. 12 is a flowchart for gripping a handrail in accordance with one embodiment of the invention.

FIG. 12 is a method for gripping a handrail having a top and bottom surface, according to one embodiment of the invention. A fixed member, coupled to a handle, is applied to one of the top and bottom surfaces of the handrail, step 92. A movable member, movable coupled to the handle, is applied to the other of the top and bottom surfaces of the handrail, step 94. In various embodiments of the invention, applying the movable member to the surface of the handrail includes activating an actuator so as to allow movement of a movable member. The actuator may control a locking cam, such that, in various embodiments of the invention, by pressing the actuator the locking mechanism is released so that the movable member can travel up or down. A force perpendicular to the top and bottom surfaces of the handrail can then be applied to the handle while holding down on the actuator, so as to allow the movable member to clamp down on the handrail with a spring force.

Once the movable member is applied to the surface of the handrail, the fixed member and movable member are locked with respect to the handrail, step 96. This may be accomplished by utilizing an/the actuator to prevent movement of the movable member. For example, releasing the actuator from a pressed position may return a locking cam to the locked position, with the necessary return force for the cam provided by a bias mechanism, which may be a spring.

The handle can now be gripped, step 98, such that a force tangential to the handrail can be applied without the device sliding on the handrail. The device can be pushed or pulled on with enough force to allow a balancing vehicle to climb or descend stairs. In various embodiments of the invention, the device is self-locking so that large initial clamping forces from the device are not necessary. The device can be used in either hand for handrails on either side, or both sides, of the stairs.

Figure 13:
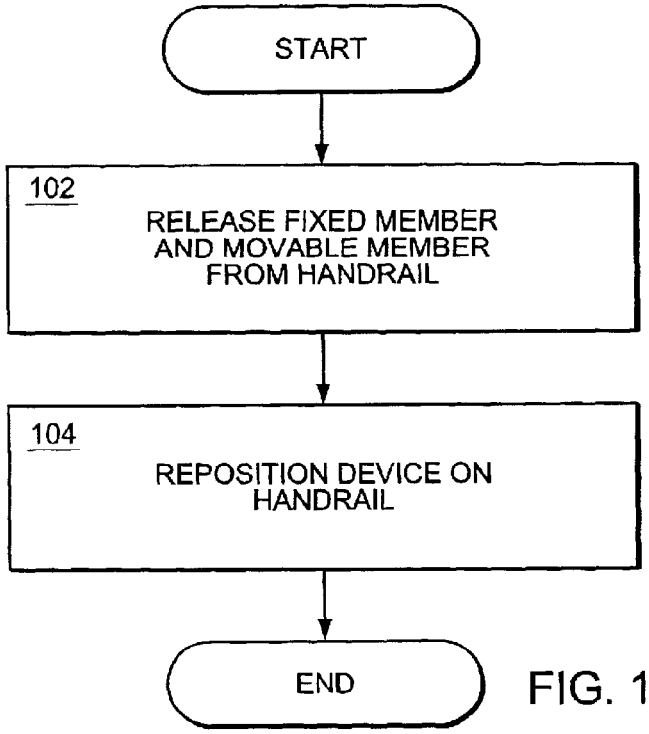
FIG. 13 is a flowchart for repositioning a device for gripping a handrail in accordance with one embodiment of the invention.

To reposition the device on the handrail, the fixed member and movable member of the device are released from the handrail, step 102 of FIG. 13. In one embodiment of the invention, this is accomplished by activating an/the actuator to allow movement of the movable member. By applying a light force to the handle that is perpendicular to the top and bottom surfaces of the handrail, the movable member can then be moved so as to unclamp the device from the handrail. For example, if the pressure foot of the movable member is engaging the top surface of the handrail, applying a slight downward force on the handle causes the pressure foot to rise. Alternatively, if the movable member is engaging the bottom surface of the handrail, applying a slight upward force on the handle will cause the pressure foot to be lowered. The device can then be repositioned on the handrail, step 104.

Figure 11:
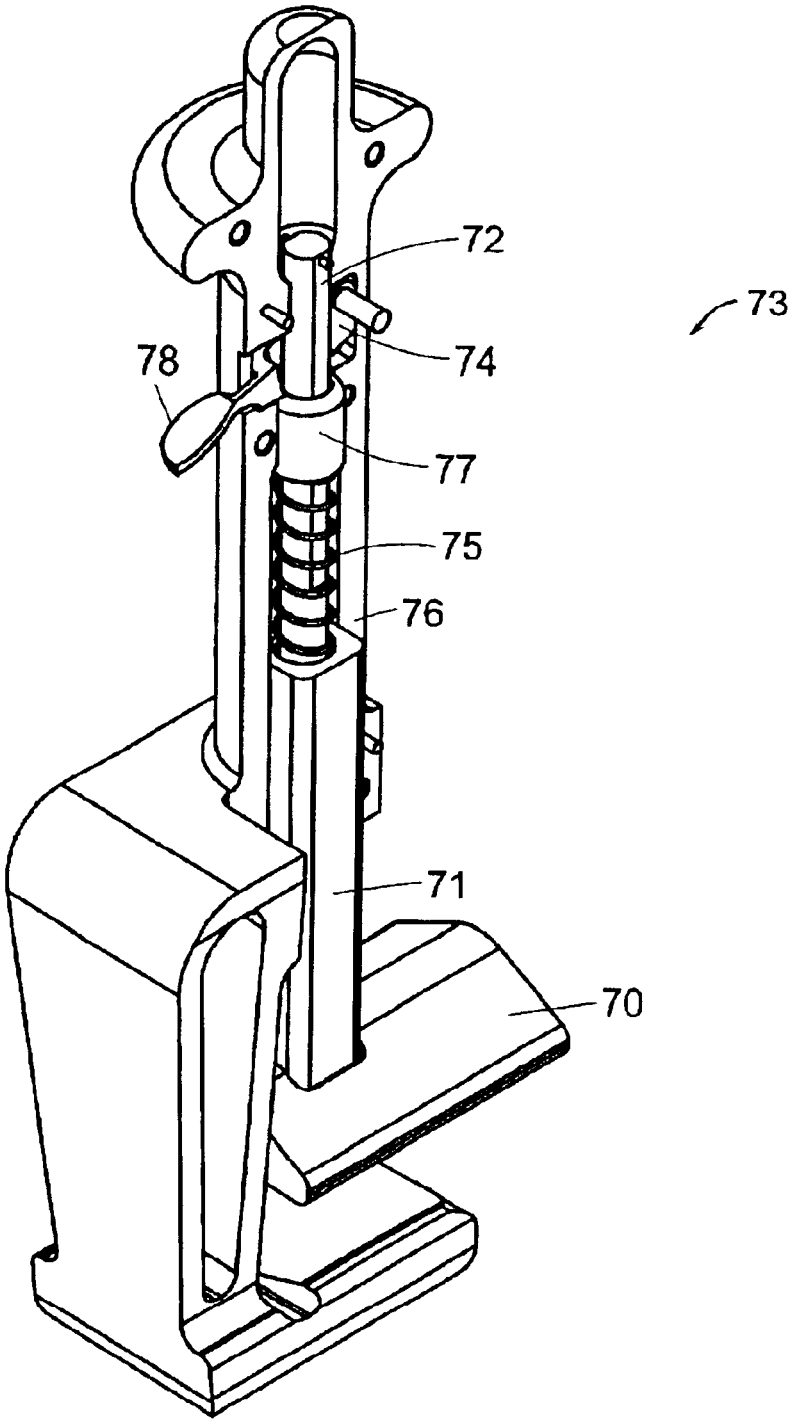
FIG. 11 is a cut-away isometric view of the device in accordance with the embodiment of FIG. 10.
Figure 14:
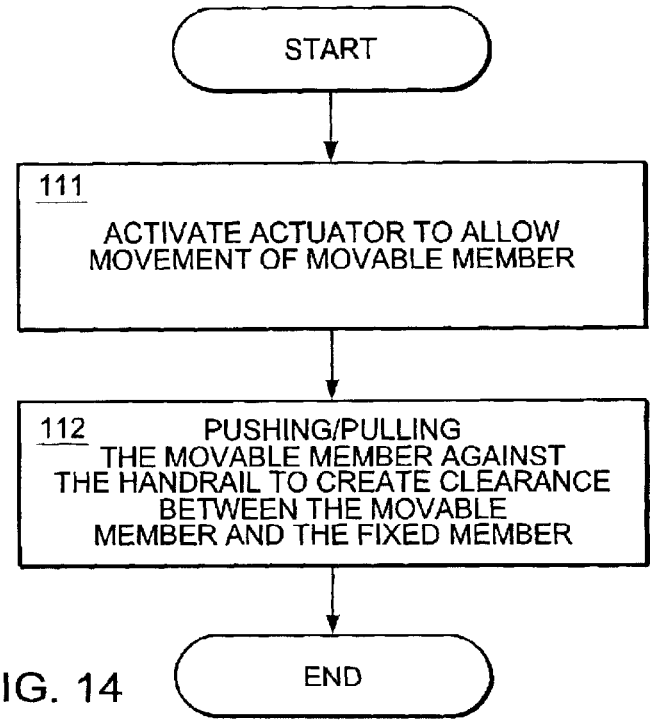
FIG. 14 is a flowchart for further separating the pressure foot from the fixed member in accordance with one embodiment of the invention.
Figure 1:
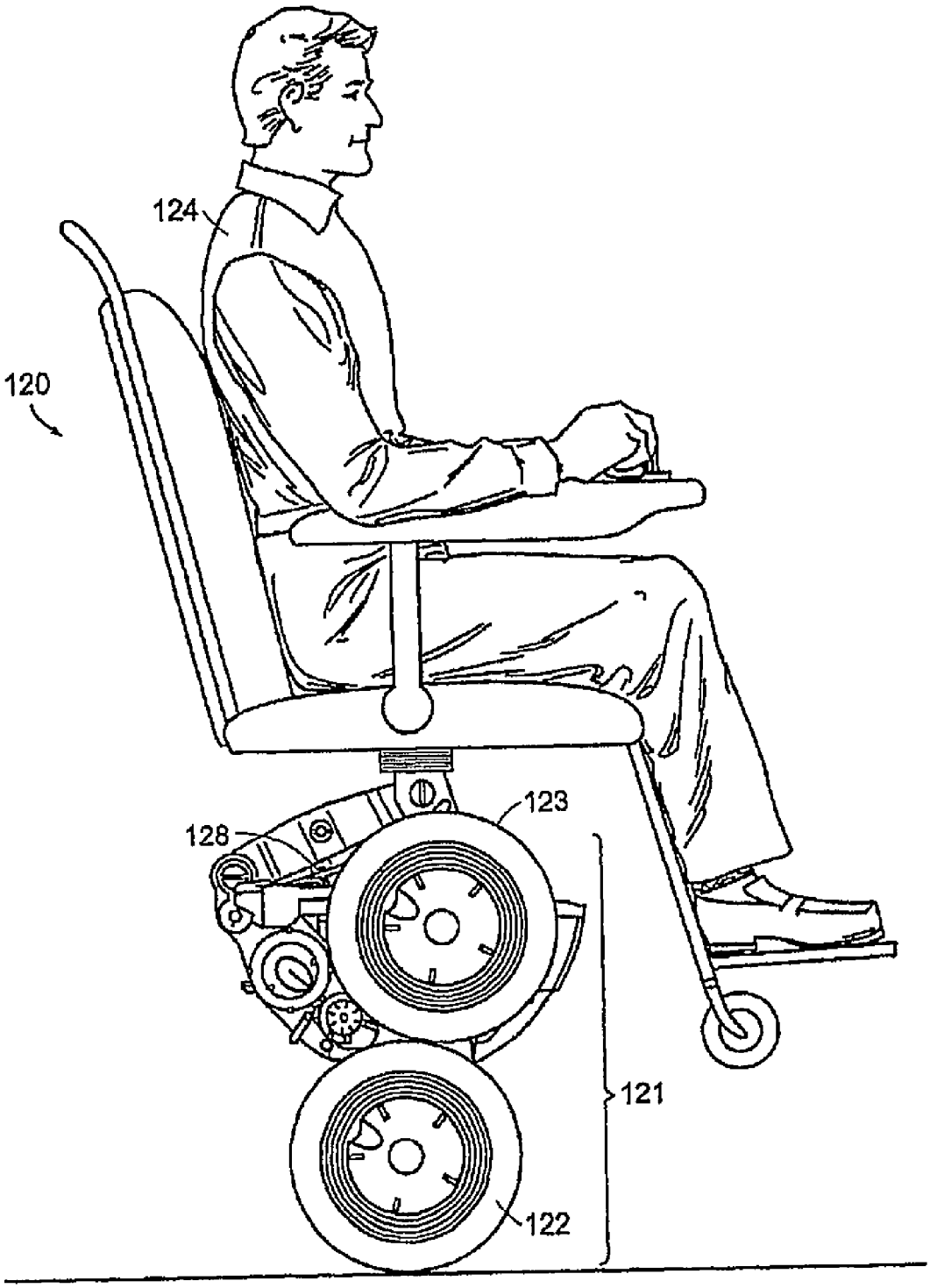
FIG. 1 PRIOR ART
Figure 2:
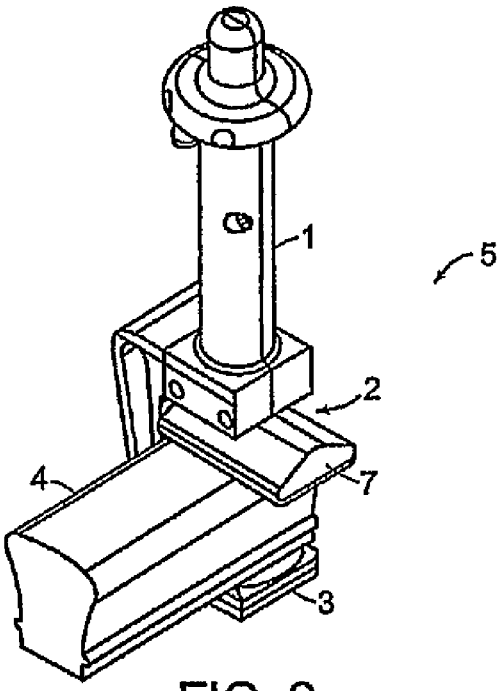
Figure 3:
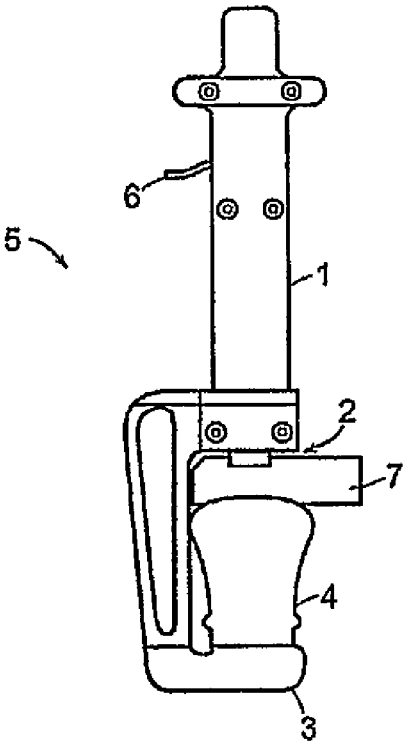
Figure 4:
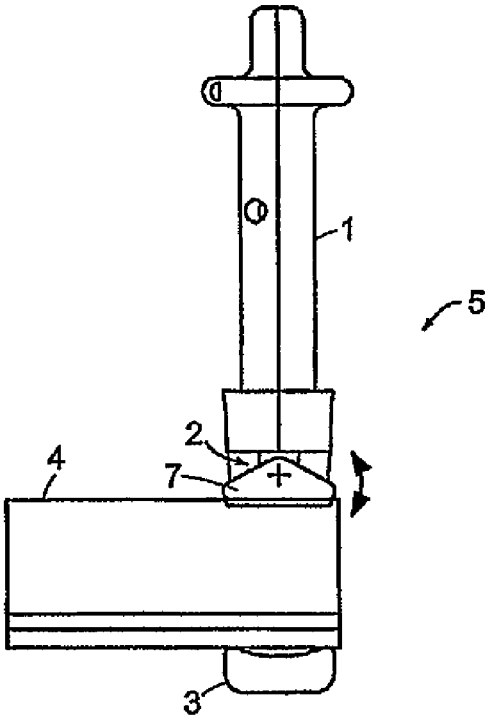
Figure 5:
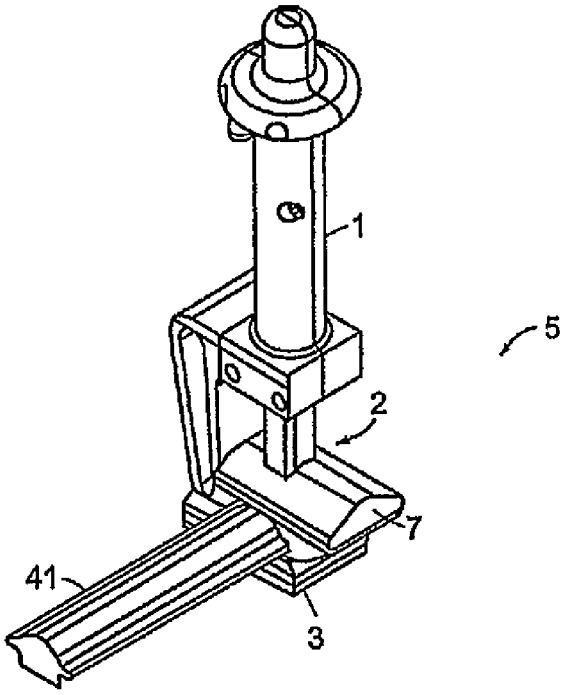
Figure 6:
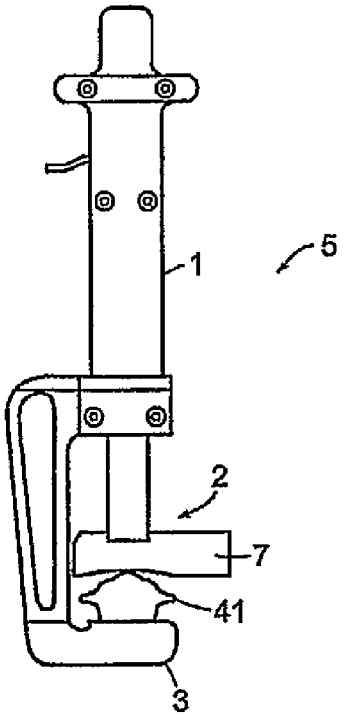
Figure 7:
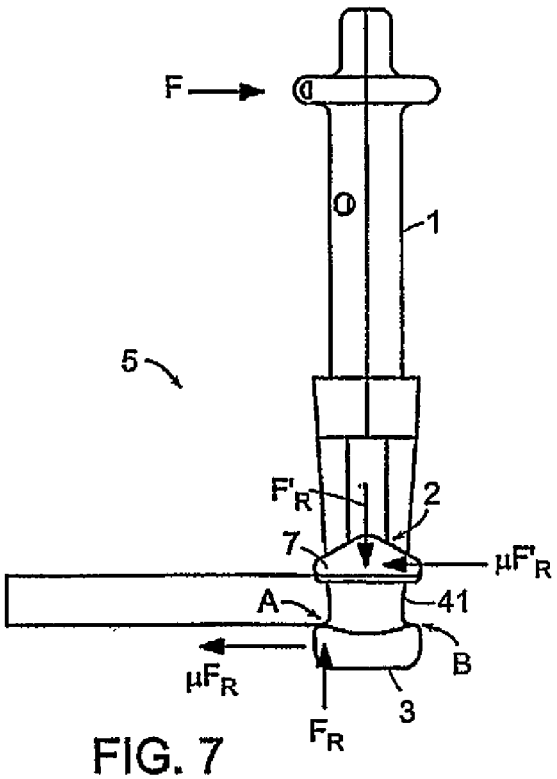
Figure 8:
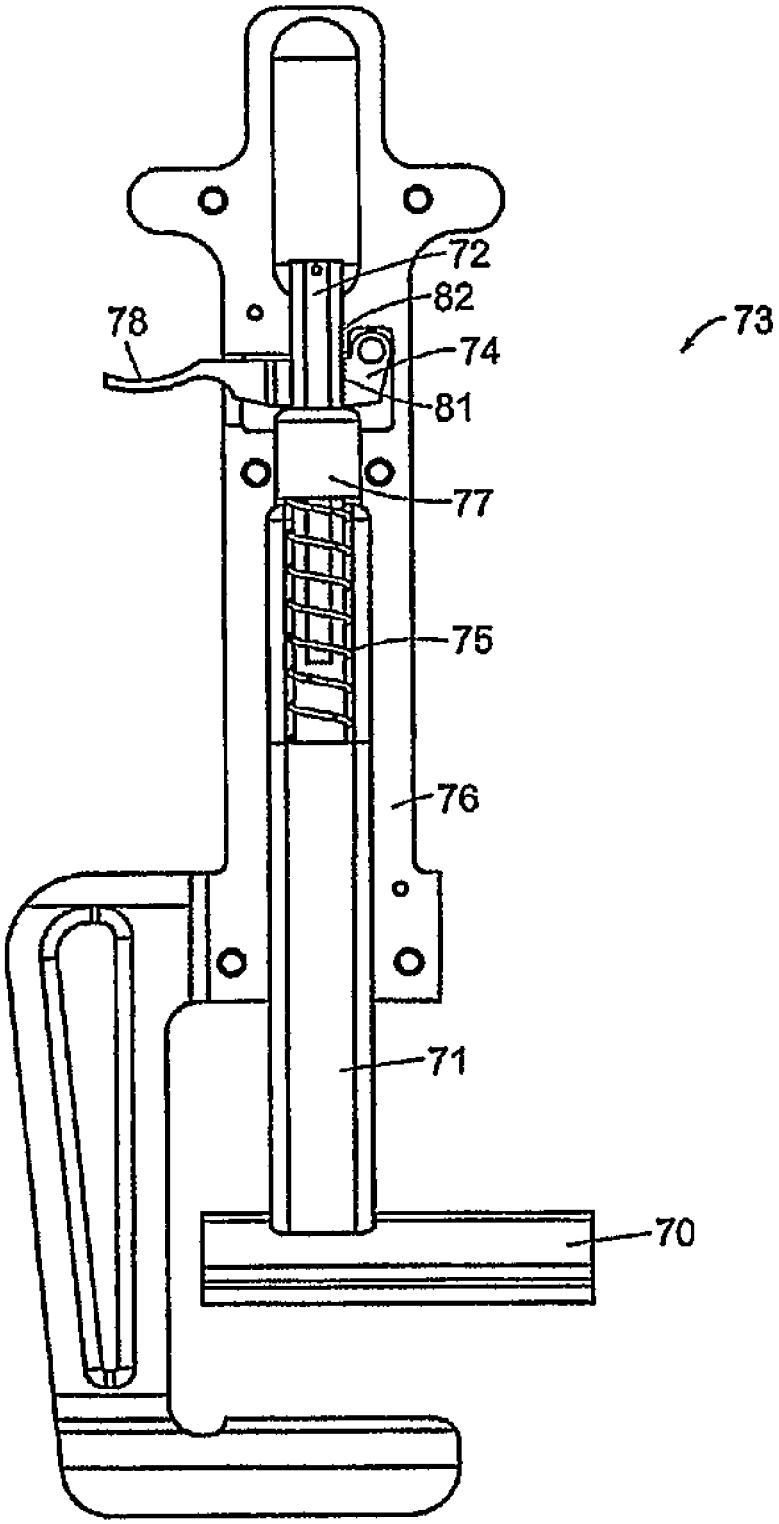
Figure 9:
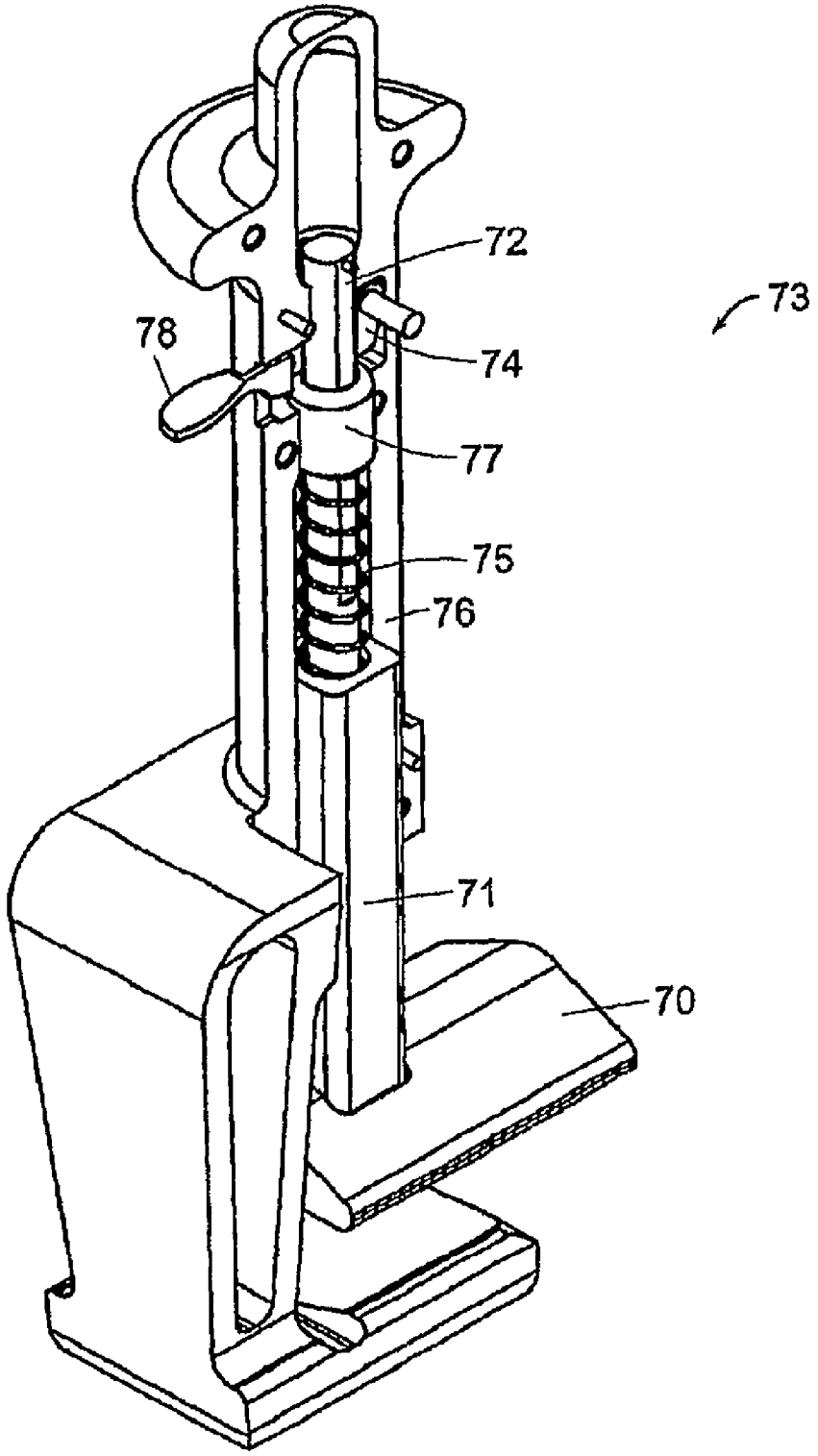
Figure 10:
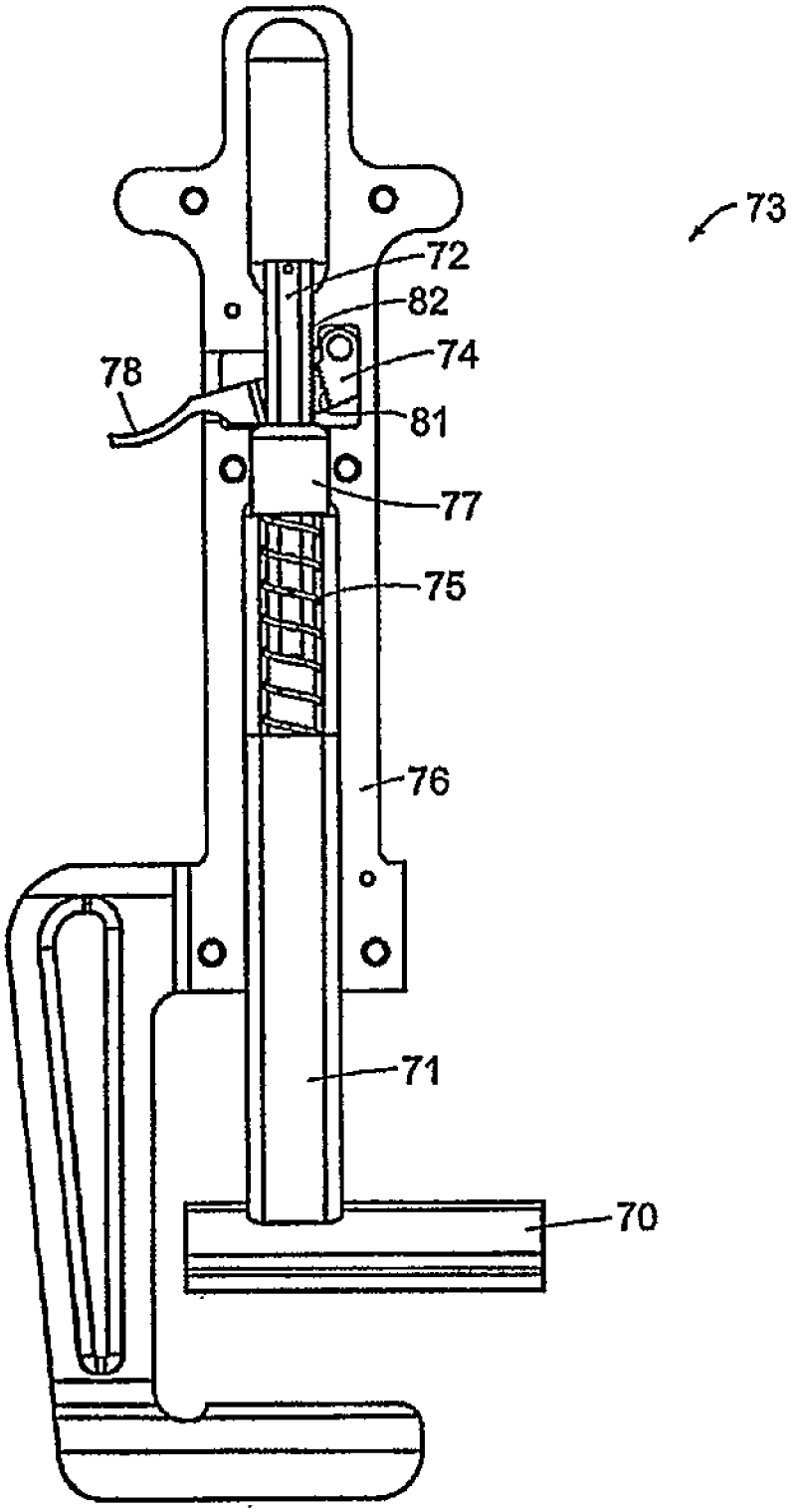
Figure 11:
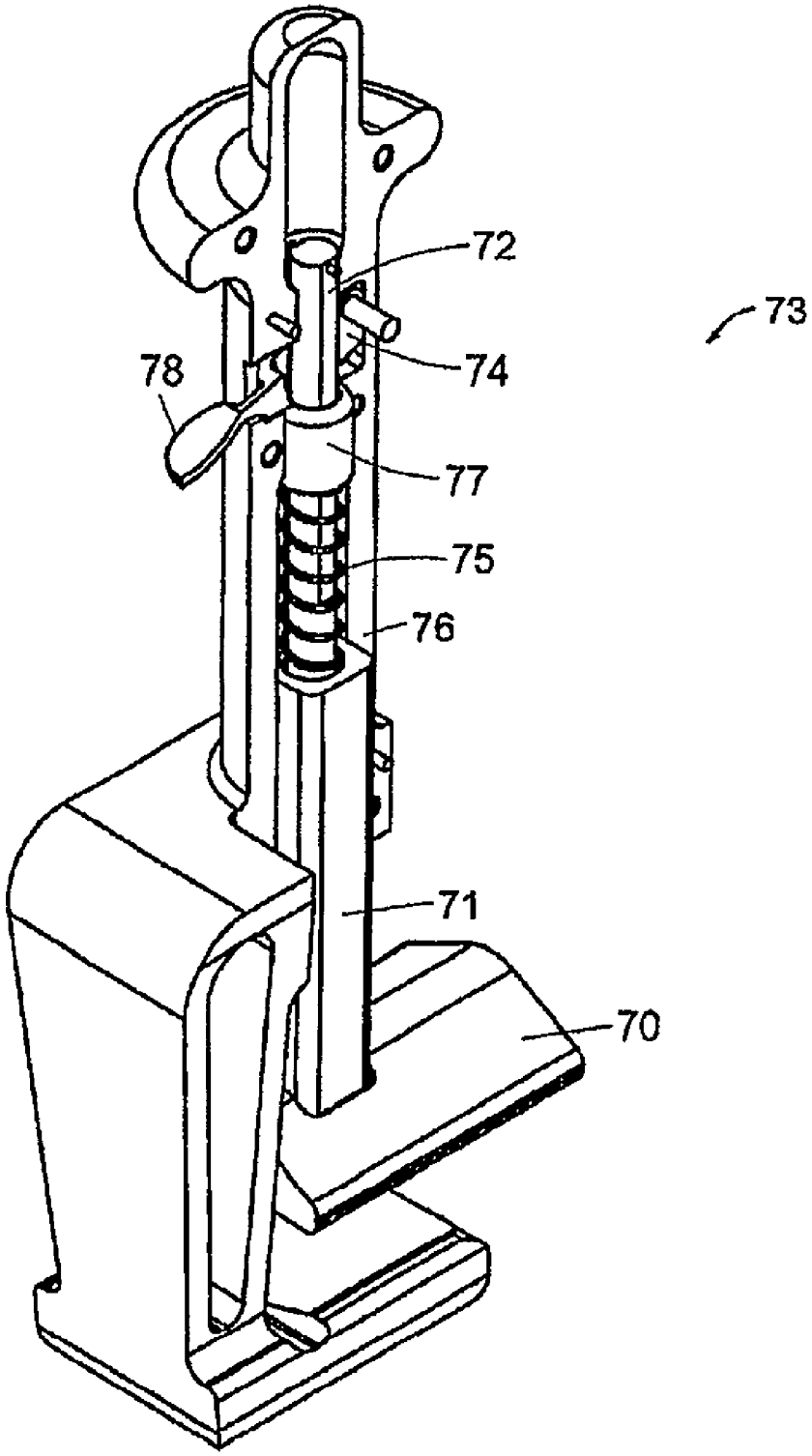
Figure 12:
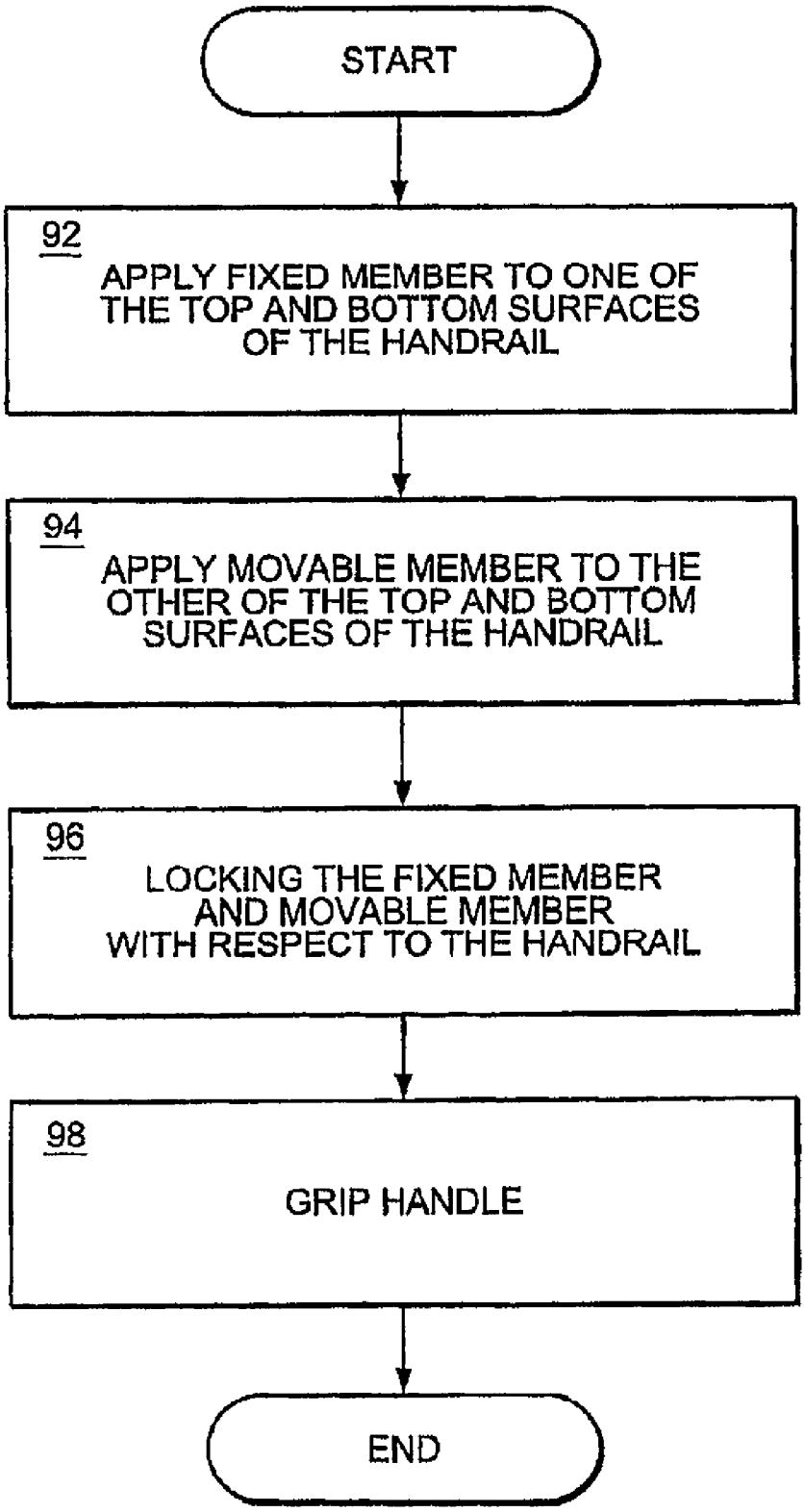
Figure 13:
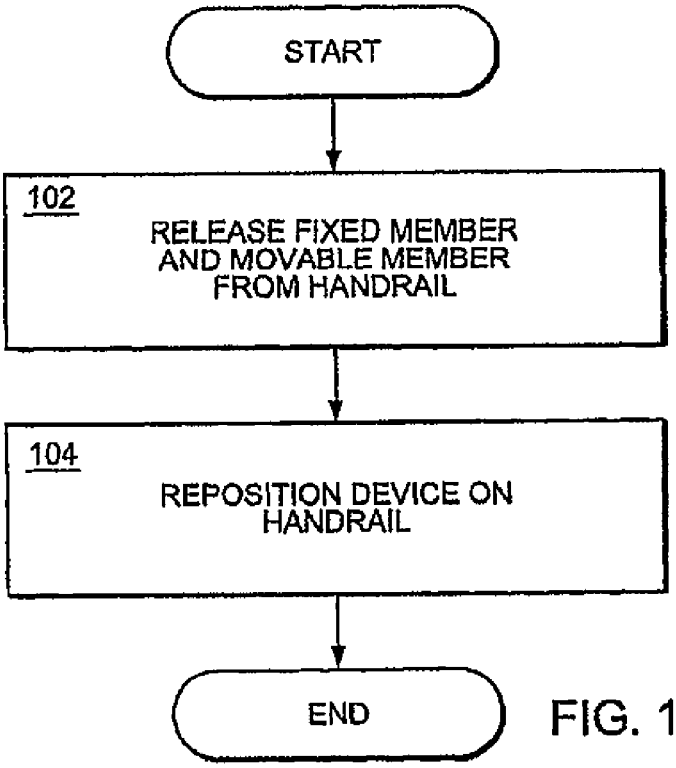
Figure 14:
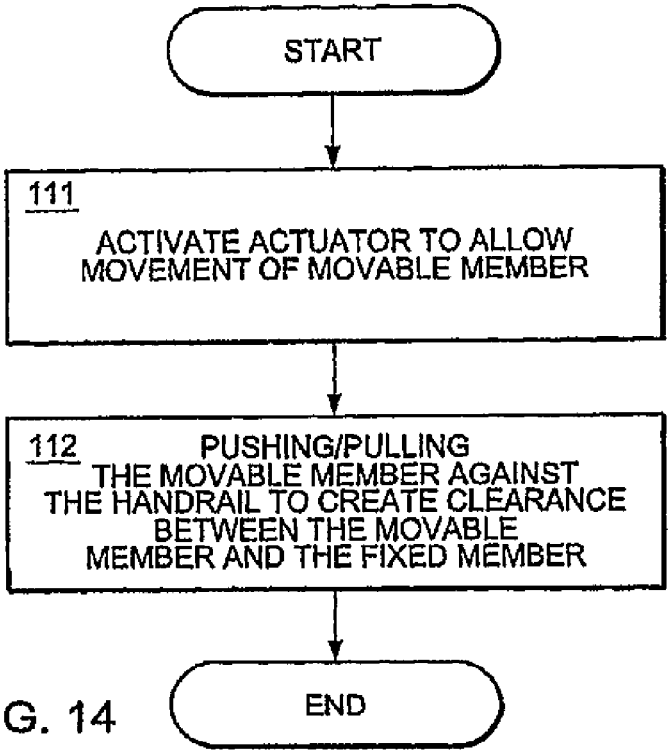

To assist when the pressure foot of the movable member is in close proximity to the fixed member, such that fixed member and movable member can not be slid over the handrail to the desired position, the pressure foot may be extended, as shown in FIG. 2. By extending the pressure foot, the movable member may be pushed against the handrail even when it is in close proximity to the fixed member. FIG. 14 is a method for separating the fixed member from the movable member in accordance with one embodiment of the invention. The actuator is activated, so as to allow movement of the movable member, step 111. The movable member is then pushed/pulled against the handrail to create clearance between the movable member and the fixed member, step 112, the movable member having an extended pressure foot such that the movable member can be pushed/pulled against the handrail when the fixed member and movable member are in close proximity. Assuming the actuator is positioned such that it can be activated with the same hand used for gripping the handle, the method described in FIG. 11 can be accomplished with a single hand.

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

What is claimed is:

1. A device, for gripping a handrail having a top and a bottom surface, the device comprising:

a. a handle for gripping by a user;

b. a fixed member coupled to the handle for engaging one of the top and bottom surfaces of the handrail;

c. a movable member movably coupled to the handle for engaging the other of the top and bottom surfaces of the handrail; and d. an actuator coupled to the handle for engaging and controlling the movement of the movable member in such a manner to allow for repositioning and locking of the device onto the handrail, so that when the device is locked onto the handrail the fixed member and movable member engage the top and bottom surfaces of the handrail such that a force tangential to the handrail can be applied to the handle without the device sliding on the handrail, wherein the device is capable of being repositioned onto the handrail when the actuator is activated and of being locked onto the handrail when the actuator is released.

2. A device according to claim 1, wherein the fixed member includes an outer jaw for engaging one of the top and bottom surfaces of the handrail.

3. A device according to claim 1, wherein the actuator includes a locking cam for controlling the movement of the movable member.

4. A device according to claim 3, wherein the locking cam includes an engageable coupling for engaging the movable member.

5. A device according to claim 4, wherein the engageable coupling includes threads.

6. A device according to claim 3, wherein the movable member includes an engageable coupling for engaging the locking cam.

7. A device according to claim 6, wherein the engageable coupling includes threads.

8. A device according to claim 3, wherein the actuator includes a bias mechanism for supplying a return force to the locking cam.

9. A device according to claim 8, wherein the bias mechanism provides a force on the movable member that is perpendicular to the top and bottom surfaces of the handrail.

10. A device according to claim 8, wherein the bias mechanism is a spring.

11. A device according to claim 10, wherein the actuator includes a guide, the guide providing a surface for the spring and locking cam to contact.

12. A device according to claim 1, wherein the device includes a bias mechanism for providing a force on the movable member that is perpendicular to the top and bottom surfaces of the handrail.

13. A device according to claim 1, wherein the movable member includes a pressure foot for engaging the other of the top and bottom surfaces of the handrail.

14. A device according to claim 13, wherein the pressure foot includes a surface that is concave for engaging the other of the top and bottom surfaces of the handrail so as to prevent slippage on the handrail.

15. A device according to claim 13, wherein the pressure foot is extended so that the pressure foot can be pushed against the handrail when the pressure foot and fixed member are in close proximity to create clearance for the device to be slid over the handrail.

16. A device, for gripping a handrail having a top surface and a bottom surface, the device comprising:

a. a handle for gripping by a user; the handle having a fixed outer jaw for engaging one of the top and bottom surfaces of the handrail, the handle having walls defining a cavity having a first entrance facing the outer jaw;

b. a foot assembly having a first end that travels inside the cavity and a second end that extends out the first entrance, the second end coupled to a pressure foot, the pressure foot having an Outer surface facing the outer jaw for engaging the other of the top and bottom surfaces of the handrail; and c. a locking cam located inside the cavity, for controlling movement of the movable foot assembly in such a manner to allow for repositioning and locking of the device onto the handrail, such that a force tangential to the handrail can be applied to the handle without the device sliding on the handrail.

17. A device according to claim 16, wherein the foot assembly includes a rod having threads for engaging the locking cam.

18. A device according to claim 17, wherein the locking cam has threads for engaging the threaded rod.

19. A device according to claim 16, wherein the locking cam includes a cam actuator that extends out a second entrance of the cavity, for controlling the locking cam.

20. A device according to claim 16, wherein the locking cam includes a bias mechanism for supplying a return force to the locking cam.

21. A device according to claim 20, wherein the bias mechanism provides a force on the movable member that is perpendicular to the top and bottom surfaces of the handrail.

22. A device according to claim 20, wherein the bias mechanism is a spring.

23. A device according to claim 16, wherein the device includes a bias like mechanism for providing a force on the movable member that is perpendicular to the top and bottom surfaces of the handrail.

24. A device according to claim 16, wherein the pressure foot includes a surface that is concave for engaging the other of the top and bottom surfaces of the handrail so as to prevent slippage on the handrail.

25. A device according to claim 16, wherein the pressure foot extends beyond the outer jaw so that the pressure foot can be pushed against the handrail when the pressure foot and the outer jaw are in close proximity to create clearance for the device to be slid over the handrail.

26. A method for gripping a handrail having a top and bottom surface, the method comprising:

a. applying a fixed member to one of the top and bottom surfaces of a handrail, the fixed member coupled to a handle;

b. activating an actuator to allow movement of a movable member movably coupled to the handle, the actuator coupled to the handle;

c. applying a force on the handle, the force being perpendicular to the top and bottom surfaces of the handrail, so as to allow the movable member to clamp down on the other of the top and bottom surfaces of the handrail with a spring force;

d. releasing the actuator to prevent movement of the movable member, so as to lock the movable member and fixed member with respect to the handrail; and e. gripping the handle.

27. A method according to claim 26, wherein activating the actuator releases a locking cam such that the movable member can move.

28. A method according to claim 26, wherein releasing the actuator returns a locking cam to a locked position, such that the movable member cannot move.

29. A method according to claim 26, wherein the method further comprises:

a. activating the actuator to allow movement of the movable member;

b. applying a force on the handle, the force being perpendicular to the top and bottom surfaces of the handrail so as to unclamp the movable member and the fixed member from the handrail; and c. repositioning the movable member onto the handrail.

30. A method according to claim 26, wherein prior to applying the fixed member, the method further comprising:

a. activating the actuator to allow movement of the movable member;

b. pushing the movable member against the handrail to create clearance between the movable member and fixed member, the movable member having an extended pressure foot so that the movable member can be pushed against the handrail when the mixed member and movable member are in close proximity.

* * * * *

UNITED STATES PATENT AND TRADEMARK OFFICE

CERTIFICATE OF CORRECTION

PATENT NO. : 6,793,258 B2
APPLICATION NO. : 10/101537
DATED : September 21, 2004
INVENTOR(S) : Larry B. Gray It is certified that error appears in the above-identified patent and that said Letters Patent is hereby corrected as shown below:

Delete drawings sheets 1-9 and substitute therefor the drawing sheets, consisting of figs. 1-14 as shown on the attached page.

Col. 8, line 45
Replace "Outer"
with --outer--

Signed and Sealed this

Twentieth Day of November, 2007

JON W. DUDAS
*Director of the United States Patent and Trademark Office*